US010363571B2

(12) United States Patent
Schulz et al.

(10) Patent No.: US 10,363,571 B2
(45) Date of Patent: Jul. 30, 2019

(54) SELF-VENTING NOZZLE

(71) Applicant: 3M INNOVATIVE PROPERTIES COMPANY, St. Paul, MN (US)

(72) Inventors: Mark F. Schulz, Lake Elmo, MN (US); Scott D. Gullicks, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 15/311,669

(22) PCT Filed: May 19, 2015

(86) PCT No.: PCT/US2015/031473
§ 371 (c)(1),
(2) Date: Nov. 16, 2016

(87) PCT Pub. No.: WO2015/179336
PCT Pub. Date: Nov. 26, 2015

(65) Prior Publication Data

US 2017/0095833 A1 Apr. 6, 2017

Related U.S. Application Data

(60) Provisional application No. 62/001,161, filed on May 21, 2014.

(51) Int. Cl.
*B05C 17/01* (2006.01)
*B05C 17/005* (2006.01)

(52) U.S. Cl.
CPC .. *B05C 17/00503* (2013.01); *B05C 17/00566* (2013.01); *B05C 17/00553* (2013.01); *B05C 17/0103* (2013.01)

(58) Field of Classification Search
CPC ..... B05C 17/00503; B05C 17/00566; B05C 17/00516
(Continued)

(56) References Cited

U.S. PATENT DOCUMENTS 6,311,871 B1 * 11/2001 Binder ..... B05C 17/00516 222/145.6
6,328,182 B1 * 12/2001 Brugner ..... B05C 17/00509 222/137
(Continued)

FOREIGN PATENT DOCUMENTS

EP 0380792 8/1990
WO WO 03/040001 5/2003

OTHER PUBLICATIONS

International Search Report for PCT International Application No. PCT/US2015/031473, dated Aug. 3, 2015, 3 pages.
(Continued)

*Primary Examiner* — Jeremy Carroll

(57) ABSTRACT

Self-venting nozzles and nozzle attachments adapted to vent a gas entrained in a fluid to an atmosphere are described. The nozzles or attachments comprise a nozzle inlet end, a nozzle outlet end, a nozzle wall extending between the nozzle inlet end and nozzle outlet end and having an interior surface defining a fluid channel surrounding a nozzle flow axis, and one or more vent passageways providing fluid communication between the fluid channel and the atmosphere. Nozzle systems comprising the self-venting nozzle and a dispenser, as well as methods of dispensing a fluid having a gas entrained therein are also described.

29 Claims, 9 Drawing Sheets

(58) Field of Classification Search
USPC ..... 222/145.6
See application file for complete search history.

(56) References Cited

U.S. PATENT DOCUMENTS

| | | | | |
|---|---|---|---|---|
| 6,443,612 | B1 * | 9/2002 | Keller | B01F 7/00141 222/145.6 |
| 9,656,224 | B2 * | 5/2017 | Linne | B01F 7/00233 |
| 2003/0222160 | A1 * | 12/2003 | Gordon | B05C 5/0216 239/602 |
| 2004/0238575 | A1 * | 12/2004 | Lawson | B41J 2/17513 222/386 |
| 2008/0144426 | A1 | 6/2008 | Janssen et al. | |
| 2010/0200614 | A1 * | 8/2010 | Von Rotz | B01F 5/0615 222/145.5 |
| 2011/0138741 | A1 * | 6/2011 | Stoeckli | B01F 5/0615 53/167 |

OTHER PUBLICATIONS

Brookfield Digital Rheometer Model DV-III Operation Instruction Manual No. M/91-210-I297, retrieved from the internet on Jan. 13, 2017.

* cited by examiner

SELF-VENTING NOZZLE

CROSS REFERENCE TO RELATED APPLICATIONS

This application is a national stage filing under 35 U.S.C. 371 of PCT/US2015/031473, filed May 19, 2015, which claims the benefit of U.S. Provisional Application No. 62/001,161, filed May 21, 2014, the disclosures of which are incorporated by reference in their entireties herein.

BACKGROUND

Adhesives, sealers, and other fluids are often dispensed from containers using an integral nozzle or a nozzle attachment to extend the fluid exit further away from the container, allowing the user to precisely dispense the fluid into areas that are difficult to access due to obstructions.

When a fluid enters an unvented nozzle attachment an air bubble is sometimes trapped in the nozzle attachment as the fluid first exits the nozzle attachment. As the fluid continues to be dispensed, this trapped air may be pulled into the fluid stream, resulting in one or more air bubbles in the dispensed fluid that may cause defects in the appearance or performance of the dispensed fluid. This phenomenon is even more common when dispensing low viscosity fluids.

Thus, there remains a need for dispensing nozzle and nozzle attachments that allow precise dispensation of fluids, including low viscosity fluids, in a manner that avoids the occurrence of air bubbles in the dispensed fluid.

SUMMARY

The self-venting nozzles described herein are adapted to vent a gas entrained in a fluid to an atmosphere, thus preventing the entrained gas from dispensing with the dispensed fluid and allowing the fluid to be dispensed from the self-venting nozzles without entrained gases or gas bubbles, thereby preventing defects in appearance or performance in the dispensed fluid.

In one or more embodiments, a self-venting nozzle is provided, adapted to vent a gas entrained in a fluid to an atmosphere, the nozzle comprising a nozzle inlet end and a nozzle outlet end. A nozzle wall extends between the nozzle inlet end and nozzle outlet end. The nozzle has an interior surface defining a fluid channel surrounding a nozzle flow axis. The nozzle also has one or more vent passageways providing fluid communication between the fluid channel and the atmosphere.

In one or more embodiments, the self-venting nozzle can further comprise a mating portion adapted to connect to a dispenser. In one or more embodiments, the mating portion is disposed on the interior surface.

In one or more embodiments, one or more vent passageways extend along the interior surface of the nozzle.

In one or more embodiments, the nozzle further comprises an exterior surface wherein the mating portion is disposed on the exterior surface. In one or more embodiments, the one or more vent passageways extend along the exterior surface.

In one or more embodiments, the one or more vent passageways extend along at least a portion of the mating portion.

In one or more embodiments, the one or more vent passageways comprise grooves in the interior surface. In one or more embodiments, the one or more vent passageways comprise grooves in the exterior surface. In one or more embodiments, the one or more vent passageways run in a direction substantially parallel to the flow axis.

In one or more embodiments, the nozzle further comprises a first non-mating portion disposed between the outlet end and the mating portion. In one or more embodiments, the one or more vent passageways extend along at least a portion of the first non-mating portion. In one or more embodiments, the nozzle further comprises a second non-mating portion disposed between the mating portion and the inlet end. In one or more embodiments, the one or more vent passageways extend along at least a portion of the second non-mating portion.

In one or more embodiments, the one or more vent passageways extend through the wall from the interior surface to the exterior surface.

In one or more embodiments, the nozzle further comprises a dynamic mixing assembly disposed upstream of the inlet end.

In one or more embodiments, the self-venting nozzle comprises a first nozzle portion and a second nozzle portion and wherein the nozzle outlet end is located on the first nozzle portion and the nozzle inlet end is located on the second nozzle portion. In one or more embodiments, the one or more vent passageways are located at an interface between the first nozzle portion and the second nozzle portion.

In one or more embodiments, the one or more vent passageways are adapted to allow passage of fluid having a viscosity of no greater than 500,000 mPa·s.

In one or more embodiments, the one or more vent passageways have an effective cross-sectional area of from $6.4\times10^{-5}$ $cm^2$ to 0.65 $cm^2$.

In one or more embodiments, a nozzle system is provided, comprising the self-venting nozzle as described herein and a dispenser. In one or more embodiments, the dispenser comprises an outlet port adapted to connect to the mating portion of the self-venting nozzle. In one or more embodiments of the system, the dispenser is arranged upstream of the self-venting nozzle. In one or more embodiments, the dispenser comprises a mixing tip. In one or more embodiments of the system, the mixing tip is a dynamic mixing tip. In one or more embodiments, the mixing tip is a static mixing tip.

In one or more embodiments, a method of dispensing a fluid having a gas entrained therein is provided, the method comprising providing a self-venting nozzle as described herein; and dispensing the fluid through the self-venting nozzle; wherein as fluid is dispensed through the self-venting nozzle, the entrained gas escapes to the atmosphere through vent passageways in the self-venting nozzle. In one or more embodiments of the method, the fluid enters the vent passageways but does not escape to the atmosphere through the vent passageways. In one or more embodiments of the method, the method further comprises mixing two or more components upstream of the self-venting nozzle to form the fluid. In one or more embodiments of the method, the fluid viscosity is no greater than 500,000 mPa·s.

The above summary is not intended to describe each embodiment or every implementation of the reservoirs and associated vent assemblies described herein. Rather, a more complete understanding of the invention will become apparent and appreciated by reference to the following Description of Illustrative Embodiments and claims in view of the accompanying figures of the drawings.

As used herein, the word "nozzle" and the phrase "nozzle attachment" are used interchangeably. Similarly, the phrases "self-venting nozzle" and "self-venting nozzle attachment" are also used interchangeably herein.

As used herein, the word "fluid" may include any flowable materials, such as, e.g., liquids, suspensions, emulsions, colloids, pastes, gels, flowable solids (e.g., flowable particulate streams), etc.

As used herein, the words "gas" and "air" are used interchangeably.

As used herein, the term "atmosphere" means the exterior area generally surrounding an article or assembly, and can include any gaseous or liquid medium, excluding the vent passageways and the fluid channel as described herein.

As used herein and in the appended claims, the singular forms "a," "and," and "the" include plural referents unless the context clearly dictates otherwise. Thus, for example, reference to "a spacer" includes a plurality of spacers (unless otherwise expressly indicated) and equivalents thereof known to those skilled in the art.

Unless otherwise indicated, all numbers expressing quantities of ingredients, viscosities, etc., in the specification and claims are to be understood as being modified by the term "about" in all instances. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical values, however, inherently contain certain errors necessarily resulting from the standard deviation found in their respective testing measurements.

DETAILED DESCRIPTION OF ILLUSTRATIVE EMBODIMENTS

Figure 1A:
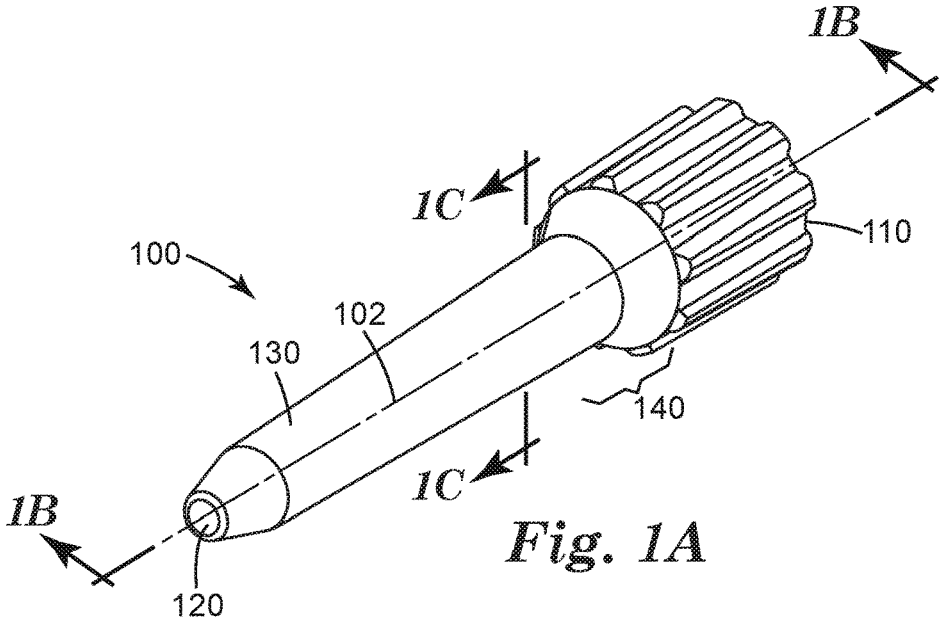
FIG. 1A is an isometric view of one illustrative embodiment of a self-venting nozzle as described herein.

In the following description of illustrative embodiments, reference is made to the accompanying figures of the drawing which form a part hereof, and in which are shown, by way of illustration, specific embodiments. It is to be understood that other embodiments may be utilized and structural changes may be made without departing from the scope of the present invention.

The present invention generally relates to the field of nozzles for dispensing fluids. More particularly, the present invention relates to devices and methods for dispensing fluids having a gas entrained therein.

When dispensing a fluid, e.g., an adhesive, a sealer, or other fluids, a nozzle or nozzle attachment is often used to control the dispensation of the fluid and allow for precise application. Often the nozzle or nozzle attachment allows the fluid to exit further from the dispensing container such that the fluid may be dispensed into areas that are difficult to access or that require precise dispensation. One problem that may arise in the dispensation of a fluid through an unvented nozzle or unvented nozzle attachment is that an air or gas bubble may become trapped in the nozzle or nozzle attachment as the fluid first exits the nozzle or nozzle attachment. During dispensation of the fluid, this trapped air or gas may be pulled into the fluid stream, resulting in one or more air or gas bubbles being trapped or entrained in the dispensed fluid. These trapped or entrained air or gas bubbles can cause defects in the appearance or performance of the dispensed fluid. This phenomenon is even more common when dispensing low viscosity fluids.

The self-venting nozzles and nozzle attachments of the present invention are designed to provide vents for the venting of the entrained gas or air bubble. In some embodiments, an entrained gas or air bubble that is initially trapped can be pushed back towards the interface of the nozzle and the dispensing container and exit through the vents. In some embodiments, the self-venting nozzles operate such that no air or gas is present in the dispensed fluid that exits the fluid channel of the self-venting nozzle through the nozzle outlet end. In some embodiments, the self-venting nozzles operate such that 5% or less, 2% or less, 1% or less, 0.5% or less, 0.25% or less (by volume) air or gas is present in the dispensed fluid that exits the fluid channel of the self-venting nozzle through the nozzle outlet end.

In some instances, an issue that may arise with vented nozzles and nozzle attachments is that the dispensed fluid may leak out through the vents, creating a messy situation and waste of dispensed fluid. In one embodiment, the self-venting nozzles and nozzle attachments of the present invention solve this additional problem by utilizing grooves that may be optimized, e.g., through size and location, to allow the air or gas to vent out of the self-venting nozzles or attachments but not allow the dispensed fluid to leak out.

The self-venting nozzles described herein can be used in a variety of environments in which a fluid, e.g. an adhesive, sealant, or other material, is dispensed from a dispenser.

Figure 1B:
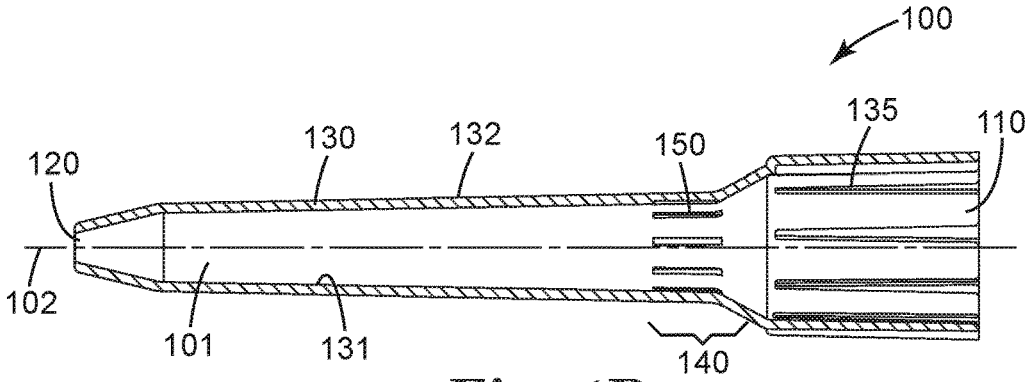
FIG. 1B is a cross-sectional view of the self-venting nozzle of FIG. 1A.
Figure 1C:
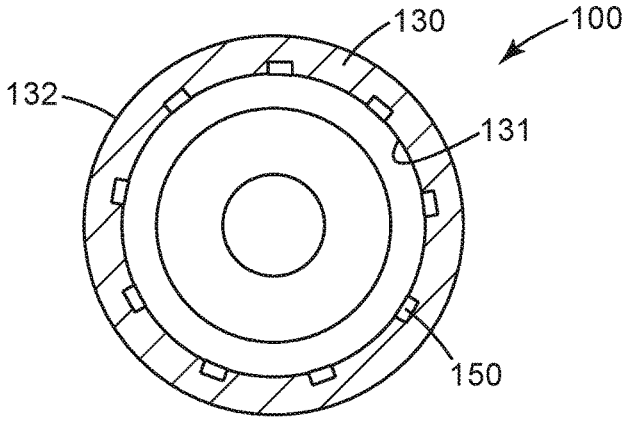
FIG. 1C is another cross-sectional view of the self-venting nozzle of FIG. 1A.

One illustrative embodiment of a self-venting nozzle as described herein is depicted in connection with FIGS. 1A-1C. FIG. 1A depicts self-venting nozzle 100 adapted to vent a gas entrained in a fluid to an atmosphere. Nozzle 100 comprises nozzle inlet end 110, nozzle outlet end 120, and nozzle wall 130 extending between the nozzle inlet end and nozzle outlet end. FIG. 1B depicts a cross-sectional view of nozzle 100 taken at 1B of FIG. 1A. As shown in FIG. 1B, in addition to nozzle inlet end 110, nozzle outlet end 120, and nozzle wall 130, nozzle 100 also has an interior surface 131 defining a fluid channel 101 surrounding nozzle flow axis 102. One or more vent passageways 150 on nozzle 100 provide fluid communication between fluid channel 101 and the atmosphere, thereby allowing venting of a gas entrained in a fluid flowing through nozzle 100. In addition, nozzle 100 has an exterior surface 132 and mating portion 140. Mating portion 140 is adapted to connect to a dispenser.

In some embodiments, such as in FIG. 1A-1C, mating portion 140 is disposed on the interior surface 131 of nozzle 100. In such embodiments, when the nozzle is connected to a dispenser, the dispenser slides into the nozzle so that the dispenser is connected to the interior surface 131 of the nozzle. In some of these embodiments, one or more vent passageways 150 are disposed on mating portion 140 and extend along the interior surface 131 of the nozzle. In some embodiments, mating portion 140 is disposed on exterior surface 132 of the nozzle 100 such that when the nozzle is connected to a dispenser, the dispenser slides over mating portion 140 of the nozzle so that the dispenser is connected to the exterior surface 132 of the nozzle. In some of these embodiments, one or more vent passageways 150 are disposed on mating portion 140 and extend along the exterior surface 132 of the nozzle.

In some embodiments, the one or more vent passageways 150 can comprise grooves in the interior surface 131. In some embodiments, the one or more vent passageways 150 can comprise grooves in the exterior surface 132. In some embodiments, the one or more vent passageways 150 can comprise holes or apertures that pass through the nozzle wall 130 between the interior surface 131 and the exterior surface 132 so as to connect the fluid channel 101 to the atmosphere directly through the nozzle wall 130. In some embodiments, particularly where the one or more vent passageways 150 comprise grooves on the interior surface 131 or exterior surface 132, the one or more vent passageways 150 run in a direction substantially parallel to the flow axis 102. In some embodiments, including some embodiments where the one or more vent passageways 150 comprise grooves on the interior surface 131 or exterior surface 132, and some embodiments where the one or more vent passageways 150 comprise holes or apertures that pass through the nozzle wall 130 between the interior surface 131 and the exterior surface 132, the one or more vent passageways 150 run in a direction that forms an angle with the flow axis 102. In some embodiments, the one or more vent passageways 150 can form curved or spiraling paths, while in other embodiments, the one or more vent passageways can form straight paths. In some embodiments, particularly where the one or more vent passageways 150 comprise holes or apertures that pass through the nozzle wall 130 between the interior surface 131 and the exterior surface 132, the one or more vent passageways 150 run in a direction substantially perpendicular to the nozzle flow axis 102. In some embodiments, the vent passageways 150 may be formed as one or more textured surfaces on the interior surface 131 of nozzle 100 that create a tortuous path for the air or gas to vent through. In some embodiments, any of the above forms of vent passageways 150 may be on the exterior surface 132 of nozzle 100, such as where nozzle 100 fits into a dispenser rather than over a dispenser. In some embodiments, the vent passageways 150 may comprise channels created between standing bosses or protrusions on the interior 131 or exterior surface 132 of the nozzle 100.

In some embodiments, mating portion 140 extends across a small section of the nozzle 100 and does not extend all the way to nozzle inlet end 110; in other embodiments, mating portion 140 can extend to and include nozzle inlet end 110. In some embodiments, nozzle attachment 100 may have one or more optional flutes or notches 135 adapted to mate with a ridge on the dispenser to aid in securing the nozzle attachment during fluid dispensation during use.

FIG. 1C depicts an alternate cross-sectional view of nozzle 100 taken at 1C of FIG. 1A and showing nozzle wall 130, interior surface 131, exterior surface 132, and one or more vent passageways 150.

Figure 2A:
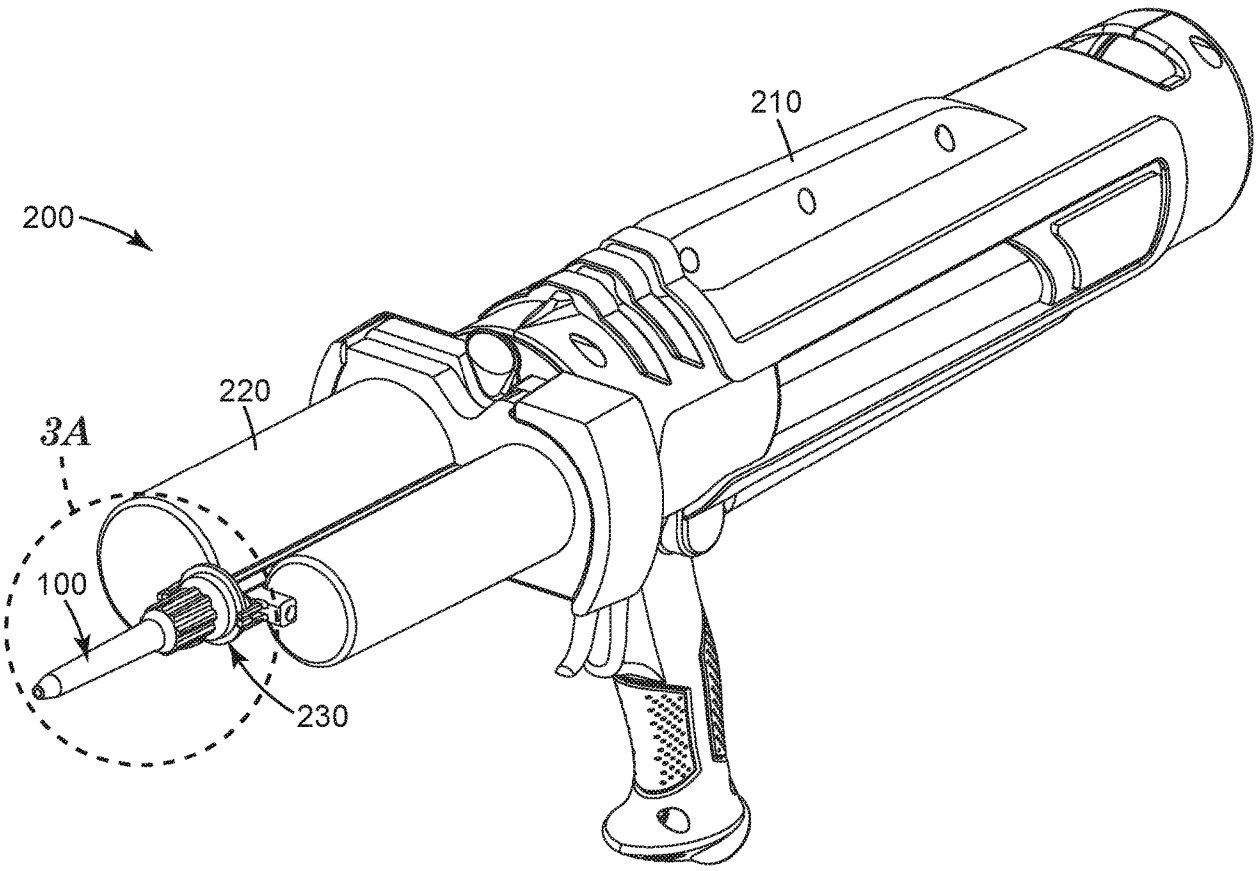
FIG. 2A is an isometric view of one embodiment of a nozzle system as described herein.
Figure 2B:
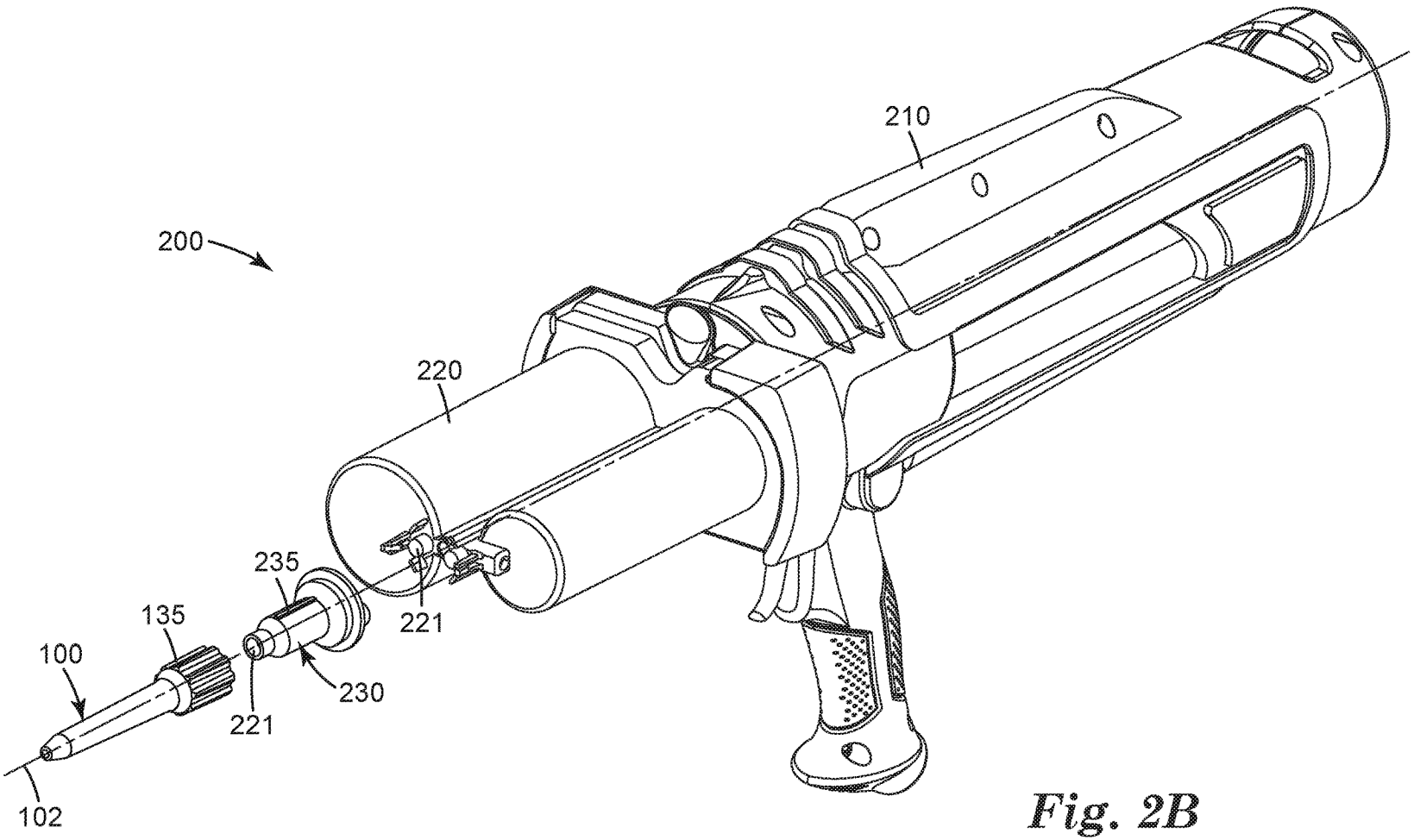
FIG. 2B is an isometric view of the nozzle system of FIG. 2A, shown in an exploded configuration.

One illustrative embodiment of a nozzle system comprising a self-venting nozzle as described herein is depicted in connection with FIGS. 2A-2B. FIG. 2A depicts a perspective view of nozzle system 200 comprising a dispenser 220 containing a fluid to be dispensed, and self-venting nozzle 100. In some embodiments, the dispenser 220 or nozzle system 200 may also comprise a means for assisting with dispensation of the fluid, such as a dispensing gun or applicator 210 as depicted in FIG. 2A. The dispenser 220 is generally arranged upstream of the self-venting nozzle 100. In some embodiments, the dispenser 220 or nozzle system 200 may comprise additional attachments to aid with dispensation or mixing of the fluid, such as a mixing tip, e.g., dynamic mixing assembly 230, or other mixing assembly. Mixing assemblies useful in the devices, systems, assemblies, and methods of the present invention include dynamic mixing assemblies such as those described in, e.g., U.S. patent application Ser. No. 11/957,296, static mixing assemblies, and other known mixing assemblies. A dynamic mixer typically includes two inlets and one outlet through which material exits the dynamic mixer after mixing. In some embodiments, the dispenser can comprise any container, such as a collapsible container, a cartridge, bulk containers that feed into a dispenser through tubes or other extensions, and the like. In some embodiments, the dispenser can comprise a mobile, enclosed dispenser that can be used to supply a single-component or mixed multi-component material at the point of use. In some embodiments, the dispenser may be a stationary dispenser. Some examples of dispensers for use with the invention include those used in vehicle body repair, those use for dental restoratives, those for use in household repair and sealing, those used in construction, industrial applications, and electronics products, etc. In some embodiments, the dispenser may include the ability to mix components in a multi-component material.

FIG. 2B depicts a perspective view of the nozzle system 200 of FIG. 2A, shown in an exploded configuration along flow axis 102. Nozzle system 200 comprises self-venting nozzle 100 and dispenser 220 containing a fluid to be dispensed and arranged upstream of self-venting nozzle 100 along flow axis 102. Nozzle system 200 also comprises mixing tip, particularly a dynamic mixing tip or dynamic mixing assembly, 230, arranged upstream of the inlet end of self-venting nozzle 100 along flow axis 102 and between self-venting nozzle 100 and dispenser 220. Nozzle system 200 further comprises optional dispensing gun or applicator 210. Dispenser 220 comprises outlet port 221. In some embodiments, outlet port 221 is adapted to connect to the mating portion 140 of self-venting nozzle 100. In some embodiments, mating portion 140 of self-venting nozzle 100 is adapted to connect to outlet port 221. In some embodiments, mixing tip 230 can also serve as dispenser 220. In such embodiments, mixing tip 230 will further comprise outlet port 221. As described above, in some embodiments, nozzle attachment 100 may have one or more optional flutes or notches 135 adapted to mate with an optional ridge 235 on the dispenser 220 to aid in securing the nozzle attachment 100 during fluid dispensation during use.

Figure 3A:
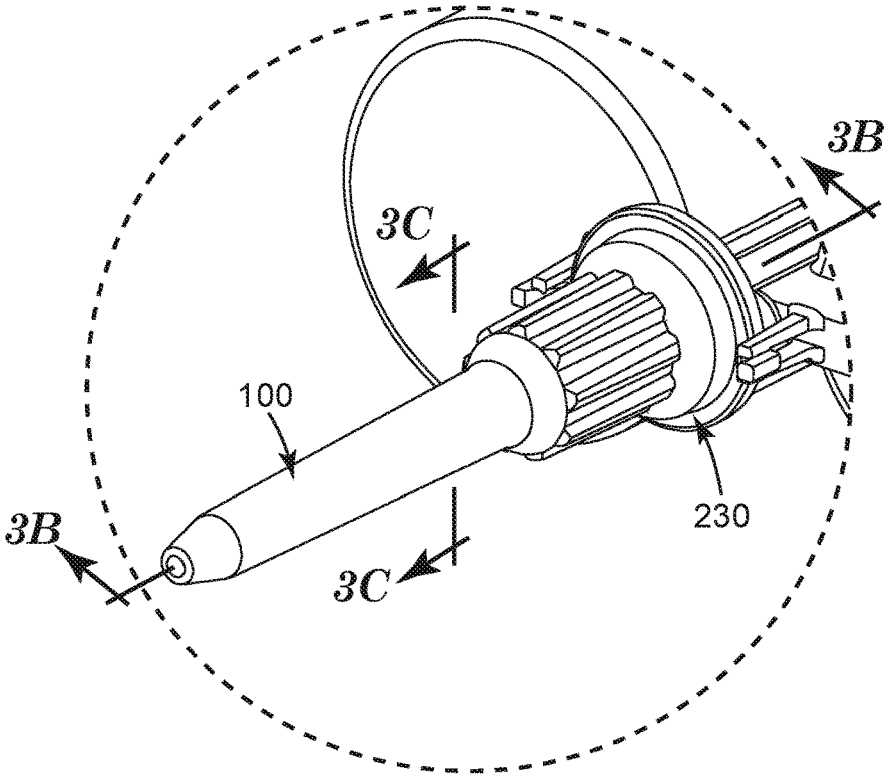
FIG. 3A is an enlarged isometric view of a portion of the nozzle system of FIG. 2A taken at 3A of FIG. 2A.
Figure 3C:
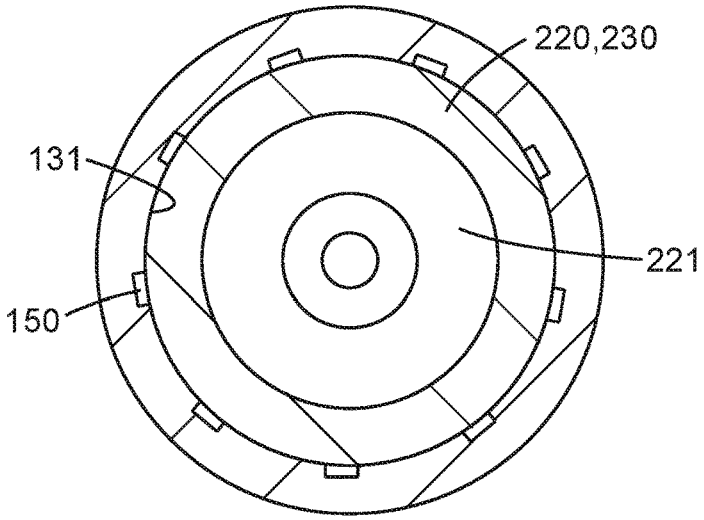
FIG. 3C is another cross-sectional view of the portion of the nozzle system of FIG. 3A.
Figure 3B:
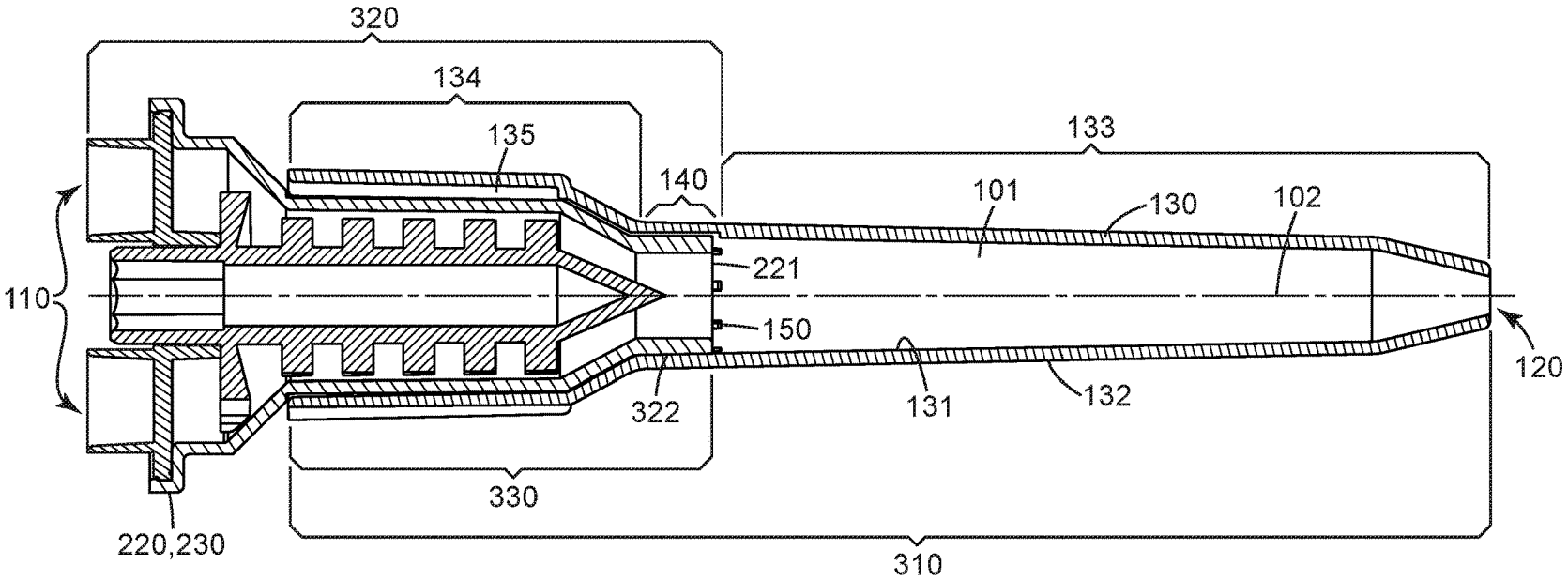
FIG. 3B is a cross-sectional view of the portion of the nozzle system of FIG. 3A.

FIGS. 3A-3C provide a more detailed view of nozzle system 200 from FIGS. 2A-2B. FIG. 3A is an enlarged perspective view of a portion of nozzle system 200 of FIG. 2A taken at 3A of FIG. 2A, showing self-venting nozzle 100 and mixing tip 230. FIG. 3B is a cross-sectional view of a portion of the nozzle system of FIG. 3A taken at 3B of FIG. 3A. FIG. 3B depicts self-venting nozzle 100 connected to mixing tip 230 or dispenser 220 at the interface 330 of mating portion 140 and outlet port 221. Nozzle 100 comprises outlet end 120 and nozzle wall 130 having an interior surface 131 and an exterior surface 132. Nozzle 100 also includes one or more optional flutes or notches 135 adapted to mate with an optional ridge on the dispenser 220 or mixing tip 230 to aid in securing the nozzle attachment 100 during fluid dispensation during use. Nozzle 100 further comprises a first non-mating portion 133 disposed between outlet end 120 and mating portion 140, and a second non-mating portion 134 disposed between mating portion 140 and inlet end 110. One or more vent passageways 150 extend along interior surface 131 and at least a portion of mating portion 140 in a direction substantially parallel to the flow axis 102, allowing gas or air entrained in a fluid in fluid channel 101 to escape through vent passageways 150 into the atmosphere. In some embodiments, the one or more vent passageways 150 also extend along at least a portion of the first non-mating portion 133. In some embodiments, the one or more vent passageways 150 also extend along at least a portion of the second non-mating portion 134.

As used herein, a dispenser can include many different forms of dispensing articles, including a container that contains fluid to be dispensed, a mechanism that pushes fluid out of another container, a nozzle or nozzle extension that assists fluid in dispensing from a container containing fluid, a nozzle extension that can mix two or more fluids together, an applicator, and the like. For example, in some embodiments, a dispenser can be a dispensing gun or applicator that provides a mechanism for pushing the dispensed fluid out of a separate cartridge or container. In some embodiments, a dispenser can be a cartridge or container that contains the fluid to be dispensed. In some embodiments, a dispenser can be a nozzle, nozzle extension, or mixing tip. Further, the phrase "adapted to connect to a dispenser" can include direct connection to a dispenser, or connection through one or more intermediate parts. For example, the self-venting nozzle may be adapted to connect to a dispenser that comprises a dispensing gun or applicator by first connecting to another nozzle or nozzle extension, or a cartridge or container that in turn connects to the dispenser or dispensing gun or applicator.

In some embodiments, the mixing tip 230 can be considered to be a dispenser 220. In some embodiments, the self-venting nozzle may comprise a first nozzle portion 310 and a second nozzle portion 320, e.g., as in FIG. 3B wherein the nozzle 100 acts as the first nozzle portion 310 and the mixing tip 230 acts as the second nozzle portion 320. In some of these embodiments, the nozzle inlet end 110 is located on the second nozzle portion 320, and the nozzle outlet end 120 is located on the first nozzle portion 310. In some of the embodiments wherein the self-venting nozzle comprises a first nozzle portion 310 and a second nozzle portion 320, the one or more vent passageways 150 are located at the interface 140 between the first nozzle portion 310 and the second nozzle portion 320. In some embodiments, the vent passageways 150 can be on the second exterior surface 322 of the second nozzle portion 320. In some embodiments, the vent passageways 150 can be on both the interior surface 131 of first nozzle portion 310 and the second exterior surface 322 of second nozzle portion 320. In some embodiments, the interface 140 may be such that the first nozzle portion fits inside the second nozzle portion in the opposite manner from that depicted in FIG. 3B (where the second nozzle portion fits inside the first nozzle portion). It should be understood that where the interface 140 consists of a male-female fit, such as one nozzle portion fitting inside the other nozzle portion, the vent passageways can be on either the exterior surface of the male-fitting nozzle portion that fits inside the other nozzle portion, or on the interior surface of the female-fitting nozzle portion that fits over the other nozzle portion.

FIG. 3C is another cross-sectional view of a portion of the nozzle system of FIG. 3A taken at 3C of FIG. 3A and showing the interface of nozzle 100 with mixing tip 230 where the interior surface 131 of nozzle wall 130 connects or mates with outlet port 221 of mixing tip 230 or dispenser 220 such that one or more vent passageways 150 pass between mixing tip 230 or dispenser 220 to allow venting of entrained gas or air to the atmosphere at the interface of the self-venting nozzle 100 and the outlet port 221 of mixing tip 230 or dispenser 220.

In some embodiments, the vent passageways are adapted such that upon exit of the gas or entrained air bubble to the atmosphere through the vent passageways, the fluid being dispensed enters the vent passageways but does not escape to the atmosphere. In some embodiments the fluid being dispensed enters the vent passageways but does not completely fill the vent passageways. In some embodiments the fluid being dispensed enters the vent passageways but does not flow beyond the vent passageways. In some embodiments, this is accomplished by altering or choosing an appropriate three-dimensional size or flow direction of the vent passageways based on the viscosity of the fluid to be dispensed. In some embodiments, it is accomplished by choosing or altering the effecting cross-sectional area of the vent passageways.

The self-venting nozzles of the present invention can accommodate a wide range of fluids with a wide range of viscosities. In some embodiments, the viscosity of the dispensed fluid may be 200,000 mPa·s or less, 100,000 mPa·s or less, 50,000 mPa·s or less, 25,000 mPa·s or less, or even 10,000 mPa·s or less. In some embodiments, the dispensed fluid may have a relatively high viscosity, e.g., 200,000 mPa·s or higher, 300,000 mPa·s or higher, 500,000 mPa·s or higher, 1,000,000 mPa·s or higher, etc. Again, the methods and devices of the present invention may preferably adapt to fluids having widely varying viscosities. The viscosity of the fluid may be determined using the procedures described in the Brookfield Digital Rheometer Model DV-III Operation Instruction Manual No. M/91-201-1297 (Brookfield Engineering Labs, Inc., Stoughton, Mass.). The spindle chosen and the shear rate selected for the test is dependent on the anticipated viscosity range. For higher viscosity materials (e.g., materials with a viscosity of 50,000 mPa·s to 10,000,000 mPa·s, the Helipath T-bar spindles may be used to obtain viscosity measurement with the spindle selected such that the torque range falls between 10% to 100% at rotational speeds of 0.5 revolutions per minute to 20 revolutions per minute on the apparatus. For some components used in connection with the present invention, the viscosity values may be measured at 5 revolutions per minute using a T-C spindle. For lower viscosity materials (e.g., materials with a viscosity of 50,000 mPa·s or less), the HA/HB spindle series may be used to obtain viscosity measurements with the spindle selected such that the torque range falls from between 10% to 100% at rotational speeds of 0.5 revolutions per minute to 20 revolutions per minute on the apparatus. For some exemplary components used in connection with the present invention, the viscosity values may be measured at 5 revolutions per minute using a HA-4 spindle. All viscosity values described are at room temperature, i.e., at approximately 20 degrees Centigrade.

In some embodiments, the vent passageways are adapted to allow passage of a fluid having a viscosity of no greater than 500,000 mPa·s. In some embodiments, the vent passageways are adapted to allow passage of a fluid having a viscosity of 300,000 mPa·s or less, a viscosity of 100,000 mPa·s or less, a viscosity of 50,000 mPa·s or less, or a viscosity of 25,000 mPa·s or less. In some embodiments, the vent passageways are adapted to allow passage of a fluid having a viscosity of from about 100 mPa·s to about 40,000 mPa·s. In some embodiments, the vent passageways are adapted to allow passage of a fluid having a viscosity of from about 500 mPa·s to about 30,000 mPa·s; 1,000 mPa·s to about 25,000 mPa·s; 2,000 mPa·s to about 25,000 mPa·s; 5,000 mPa·s to about 25,000 mPa·s; or 10,000 mPa·s to about 25,000 mPa·s. In some embodiments, the vent passageways are adapted to allow passage of a fluid having a viscosity of from about 15,000 mPa·s to about 25,000 mPa·s.

In some embodiments, the vent passageways have a height or gap distance ranging from about 0.0254 mm to 2.54 mm. Height or gap distance of the vent passageways is intended to include the measurement of the distance between two opposing sides of the vent passageways. For example, in embodiments where the cross-sectional shape of the vent passageway is rectangular, the height or gap distance can be measured between any two opposing sides of the rectangle. One of skill in the art can appreciate that specific gap distances are not necessary for each intended application, and where a specific gap distance is desired for the specific use, such gap distance will vary based on viscosity of the dispensed fluid. One of skill in the art can also appreciate that for embodiments where gap distance is specified, only one of the sets of opposing sides need meet the reported gap distance. For example, a short but wide rectangular cross-sectional shape may be used for vent passageways in some embodiments. As another example of measuring gap distance, in embodiments where the cross-sectional shape of the vent passageway is annular, the diameter of the cross-sectional shape may be used to calculate gap distance. It can be appreciated by one skilled in the art that gap distances represent an average gap distance, particularly in embodiments where the cross-sectional shape of the vent passageway is irregular, such as in the case of textured surfaces or winding paths. The gap distance of the vent passageways can be readily measured by those skilled in the art using a variety of well known methods and measurement tools and techniques, such as the use of calipers, coordinate measuring machines, micrometers, feeler or gap gauges, and the like.

In some embodiments, the vent passageways have an effective cross-sectional area. The effective cross-sectional area of the vent passageway is intended to describe the geometric area, measured at cross-sectional slices of the vent passageway and averaged. In some embodiments, effective cross-sectional areas ranging from about $6.4\times10^{-4}$ $mm^2$ to about 6.5 $mm^2$ and allow entrapped air or gas to evacuate to the atmosphere through the cross-section of the vent while providing enough resistance to prevent the dispensed fluid from evacuating to atmosphere along the length of the vent. It can be appreciated by one skilled in the art that effective cross-sectional area represents an average effective cross-sectional area, particularly in embodiments where the cross-sectional shape of the vent passageway is irregular, such as in the case of textured surfaces or winding paths. The effective cross-sectional area of the vent passageways can be readily measured and calculated by those skilled in the art using a variety of well known methods and measurement tools and techniques, such as the use of calipers, coordinate measuring machines, micrometers, feeler or gap gauges, and the like.

In some embodiments, the vent passageways have a vent length, which is intended to describe the path distance that air, gas, or fluid may travel along the vent passageway prior to exiting to the atmosphere. In some embodiments, vent lengths may range from about 0.0254 mm to 25.4 cm. and allow entrapped air or gas to evacuate to the atmosphere through the cross-section of the vent while providing enough resistance to prevent the dispensed fluid from evacuating to atmosphere along the length of the vent. In some embodiments, such as in the case of textured surfaces or winding paths, the vent length may describe the shortest straight-line distance between the vent passageway entrance from the fluid channel and the vent passageway exit to the atmosphere. The vent lengths of the vent passageways can be readily measured or calculated by those skilled in the art using a variety of well known methods and measurement tools and techniques, such as the use of calipers, coordinate measuring machines, micrometers, feeler or gap gauges, and the like.

As many different types of fluids having varying fluid viscosities can be dispensed through the nozzles described herein, it is impractical to provide parameters such as gap distance, cross-sectional area, and vent length for the vent passageways for each type of fluid; however, one skilled in the art can easily select, based on the disclosures herein, the appropriate dimensions and characteristics of the vent passageways for the particular fluid being dispensed and the particular use.

Methods of using the self-venting nozzles described herein are also provided. The present invention provides a method of dispensing a fluid having a gas entrained therein. The method comprises providing a self-venting nozzle as described herein and dispensing the fluid through the self-venting nozzle, wherein as fluid is dispensed through the self-venting nozzle, the entrained gas escapes to the atmosphere through the vent passageways in the self-venting nozzle. In some embodiments of the method, the fluid may enter the vent passageways but does not escape to the atmosphere through the vent passageways. In some embodiments, the method may further comprise mixing two or more components upstream of the self-venting nozzle to form the fluid, e.g., in cases where a two-part sealant will form the fluid. In some embodiments of the method, the viscosity of the fluid is no greater than 500,000 mPa·s. In some embodiments, the viscosity of the fluid is 300,000 mPa·s or less, 100,000 mPa·s or less, 50,000 mPa·s or less, or 25,000 mPa·s or less. In some embodiments the viscosity of the fluid is from about 10,000 mPa·s to about 25,000 mPa·s. In some embodiments, the viscosity of the fluid is from about 100 mPa·s to about 40,000 mPa·s. In some embodiments, the vent passageways are adapted to allow passage of a fluid having a viscosity of from about 500 mPa·s to about 30,000 mPa·s; 1,000 mPa·s to about 25,000 mPa·s; 2,000 mPa·s to about 25,000 mPa·s; 5,000 mPa·s to about 25,000 mPa·s; or 10,000 mPa·s to about 25,000 mPa·s. In some embodiments, the viscosity of the fluid is from about 15,000 mPa·s to about 25,000 mPa·s. In some embodiments, the viscosity of the fluid is from about 18,000 mPa·s to about 22,000 mPa·s.

Figure 4A:
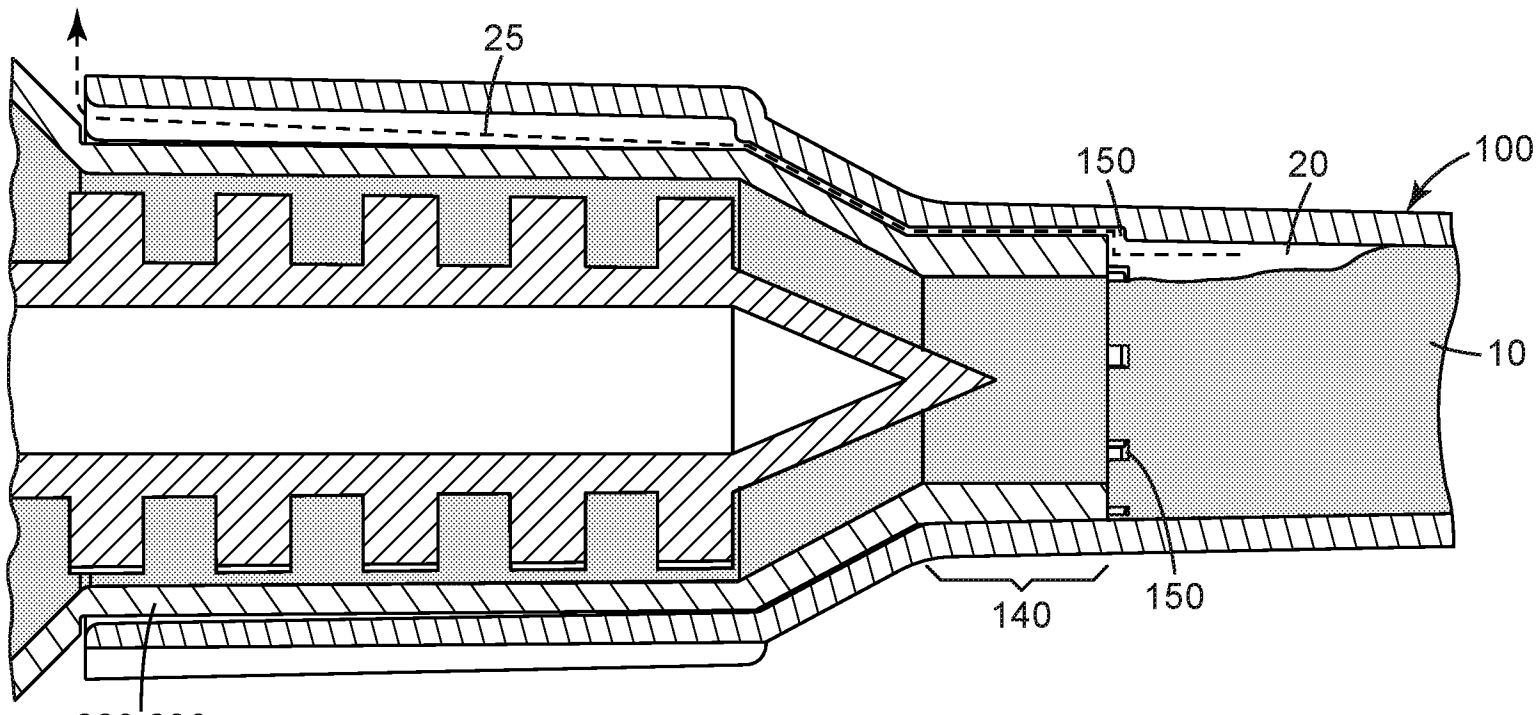
FIG. 4A is an enlarged cross-sectional view of one embodiment of a nozzle system as described herein, taken during operation of the nozzle system at a first time.
Figure 4B:
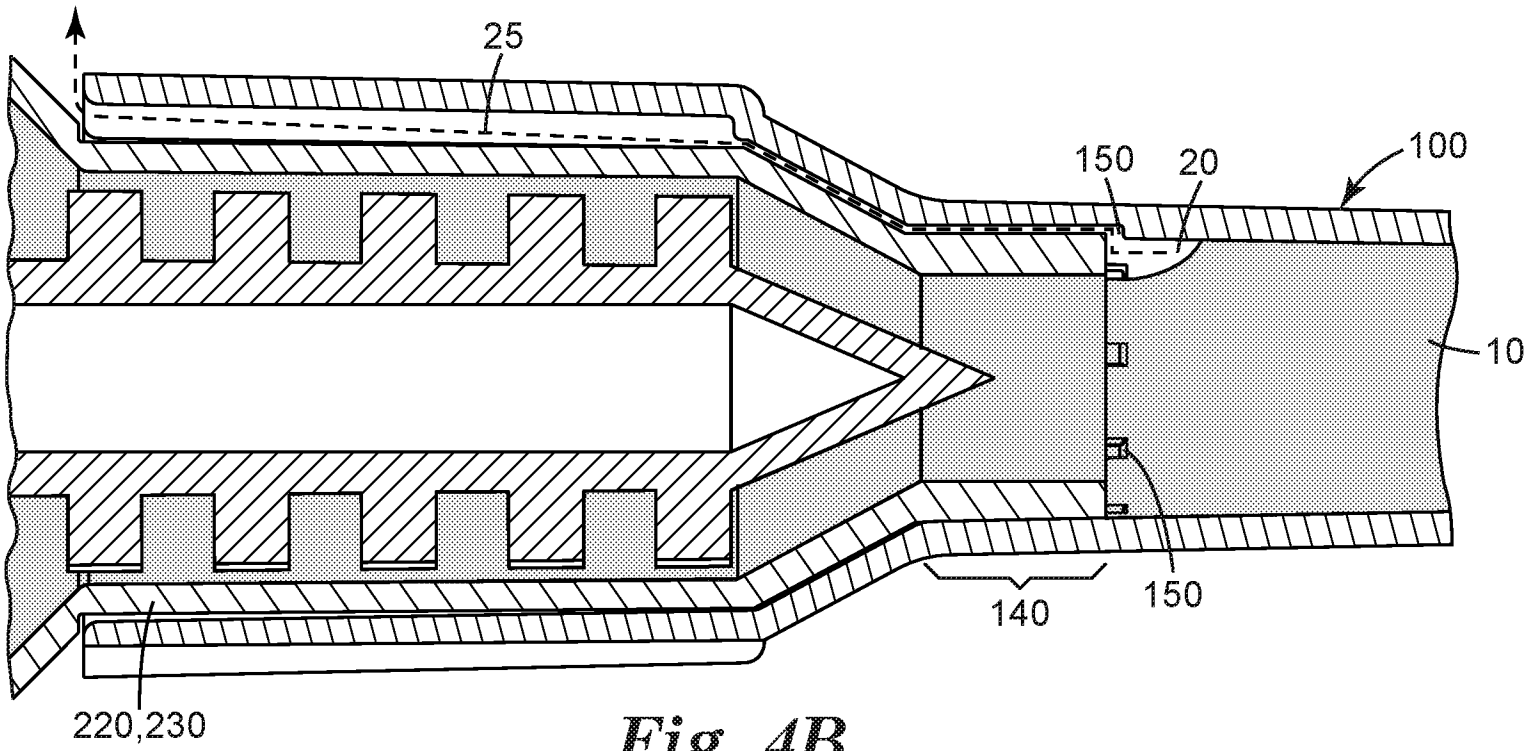
FIG. 4B is an enlarged cross-sectional view the nozzle system of FIG. 4A, taken during operation of the nozzle system at a second time.
Figure 4C:
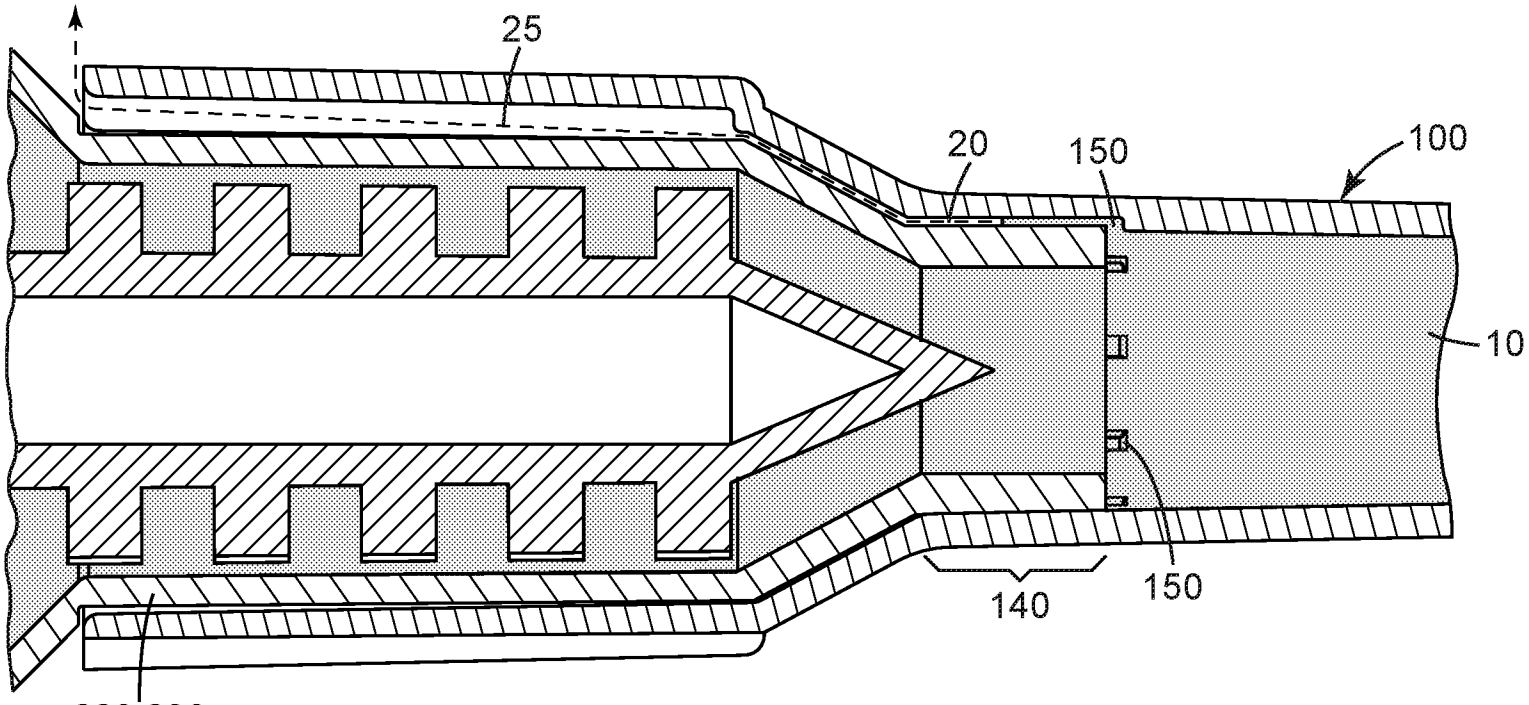
FIG. 4C is an enlarged cross-sectional view the nozzle system of FIG. 4A, taken during operation of the nozzle system at a third time.
Figure 5:
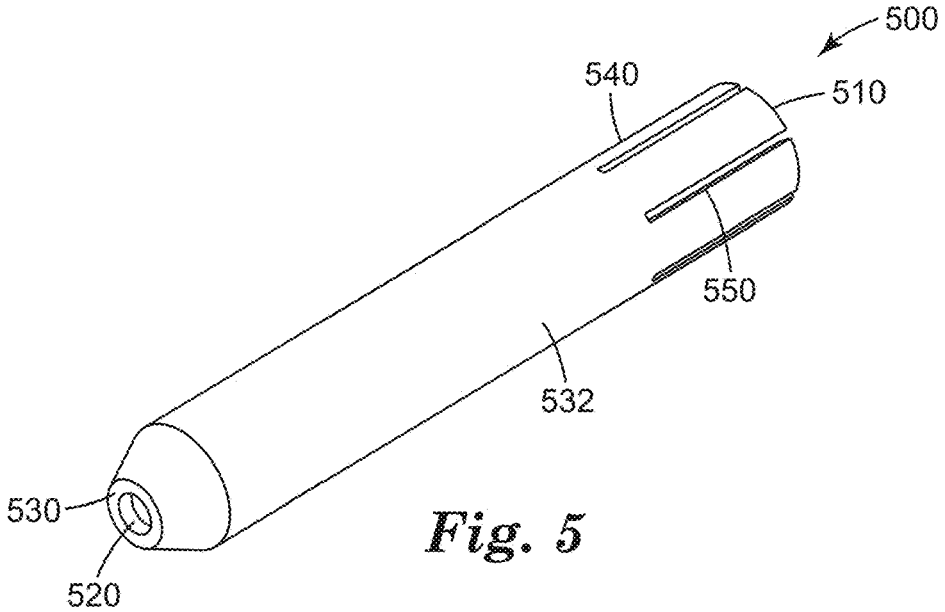
FIG. 5 is an isomeric view of one illustrative embodiment of a self-venting nozzle as described herein.
Figure 6:
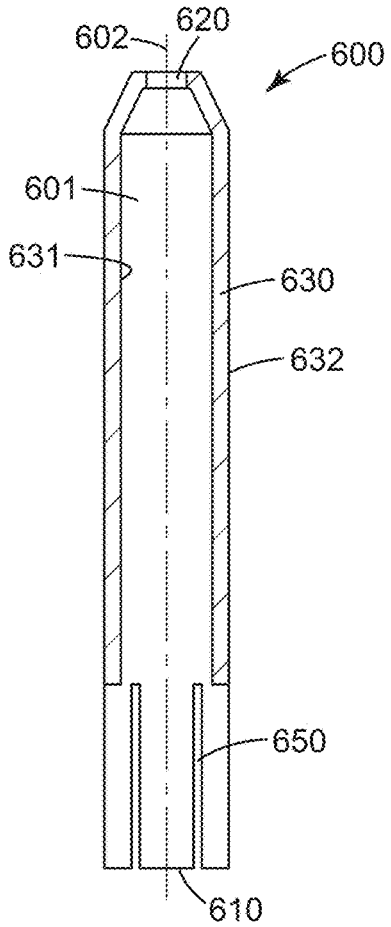
FIG. 6 is a cross section of the self venting nozzle of FIG. 5.

One illustrative embodiment of the methods described herein is depicted in connection with FIGS. 4A-4C. FIG. 4A is an enlarged cross-sectional view of one embodiment of a nozzle system 200 as described herein, taken during operation of the nozzle system 200 at a first time. The nozzle system comprises a self-venting nozzle 100 connected to a mixing tip 230 or dispenser 220 at nozzle inlet end 110 and mating portion 140. Fluid 10 is dispensed through outlet port 221 of mixing tip 230 or dispenser 220 into fluid channel 101 of self-venting nozzle 100 to be dispensed out of the nozzle outlet end (not shown). A gas 20 is entrained in fluid 10 but has begun to evacuate out of fluid 10 and self-venting nozzle 100 through vent passageways 150 along gas escape path 25 to the atmosphere. FIG. 4B is an enlarged cross-sectional view the nozzle system of FIG. 4A, taken during operation of the nozzle system at a second time. FIG. 4B shows that the entrained gas 20 has progressed in evacuating out of fluid 10 and self-venting nozzle 100 through vent passageways 150 along gas escape path 25 to the atmosphere.

FIG. 4C is an enlarged cross-sectional view the nozzle system of FIG. 4A, taken during operation of the nozzle system at a third time. FIG. 4C shows that the entrained gas 20 has progressed further in evacuating out of fluid 10 and self-venting nozzle 100 through vent passageways 150 along gas escape path 25 to the atmosphere and is no longer present in fluid channel 110. In addition, FIG. 4C shows that fluid 10 has entered vent passageways 150, but has not escaped to the atmosphere.

The self-venting nozzles described herein may be useful for dispensing any fluid, including fluid systems that comprise more than one fluid, such as two-part sealant systems that require mixing of the fluids prior to or during dispensation. In such instances, a mixing assembly, such as a dynamic mixing assembly, static mixing assembly, or other mixing assembly may be arranged upstream of the self-venting nozzle. In some embodiments, the fluid that enters the fluid channel through the nozzle inlet end from the outlet port of the dispenser includes little or no entrapped air or gas. In some embodiments, the fluid that enters the fluid channel through the nozzle inlet end from the outlet port of the dispenser includes air in the amount of 5% or less, 2% or less, 1% or less, 0.5% or less, 0.25% or less (by volume)—where entrained gas or air is air that is not enclosed within any hollow elements (if present) in fluid. In some embodiments, entrained gas is introduced into the fluid while the fluid is in the fluid channel of the nozzle. It is this entrained gas that is vented out of the fluid in the self-venting nozzle though the one or more vent passageways into the atmosphere.

The self-venting nozzles and methods described herein are useful in dispensing various types of fluids, including curable and non-curable materials such as, e.g., epoxies, urethanes, silicones, vinyl esters, polyesters, polysulfides, polyethers, acrylics, and the like, or combinations thereof. The dispensed fluids may include fillers such as, e.g., talc, clays, pigments, dispersion stability additives (e.g., amorphous silica), glass microspheres, etc. The fluids may also include unsaturated reactive diluents such as, e.g., styrene. The fluids may also include additives to impart adhesion of the materials to common repair surfaces such as, e.g., aluminum, galvanized steel, E-coats, primers, paints, etc. The adhesion additives may have, e.g., anhydride functionality, silane functionality, or amine functionality, and the adhesion additives may or may not be incorporated into the base resin.

The methods described herein can be useful in a variety of applications, including repair and construction of items such as, e.g., the construction or repair of buildings, cars, trucks, watercraft, windmill blades, aircraft, recreational vehicles, bathtubs, storage containers, pipelines, etc.

The following embodiments are intended to be illustrative of the present disclosure and not limiting.

Embodiment 1 is a self-venting nozzle adapted to vent a gas entrained in a fluid to an atmosphere, the nozzle comprising:

a nozzle inlet end;

a nozzle outlet end;

a nozzle wall extending between the nozzle inlet end and nozzle outlet end and having an interior surface defining a fluid channel surrounding a nozzle flow axis; and one or more vent passageways providing fluid communication between the fluid channel and the atmosphere.

Embodiment 2 is the self-venting nozzle of embodiment 1, wherein the nozzle comprises a mating portion adapted to connect to a dispenser.

Embodiment 3 is the self-venting nozzle of embodiment 2, wherein the mating portion is disposed on the interior surface.

Embodiment 4 is the self-venting nozzle of any of the preceding embodiments, wherein the one or more vent passageways extend along the interior surface.

Embodiment 5 is the self-venting nozzle of embodiment 2, further comprising an exterior surface wherein the mating portion is disposed on the exterior surface.

Embodiment 6 is the self-venting nozzle of embodiment 5, wherein the one or more vent passageways extend along the exterior surface.

Embodiment 7 is the self-venting nozzle of any one of embodiments 2-6, wherein the one or more vent passageways extend along at least a portion of the mating portion.

Embodiment 8 is the self-venting nozzle of any one of embodiments 1-4 or 7, wherein the one or more vent passageways comprise grooves in the interior surface.

Embodiment 9 is the self-venting nozzle of any one of embodiments 5-7, wherein the one or more vent passageways comprise grooves in the exterior surface.

Embodiment 10 is the self-venting nozzle of any one of the preceding embodiments, wherein the one or more vent passageways run in a direction substantially parallel to the flow axis.

Embodiment 11 is the self-venting nozzle of any one of embodiments 2-10, wherein the nozzle further comprises a first non-mating portion disposed between the outlet end and the mating portion.

Embodiment 12 is the self-venting nozzle of embodiment 11, wherein the one or more vent passageways extend along at least a portion of the first non-mating portion.

Embodiment 13 is the self-venting nozzle of any one of embodiments 2-12, wherein the nozzle further comprises a second non-mating portion disposed between the mating portion and the inlet end.

Embodiment 14 is the self-venting nozzle of embodiment 13, wherein the one or more vent passageways extend along at least a portion of the second non-mating portion.

Embodiment 15 is the self-venting nozzle of any one of embodiments 1-4, wherein the one or more vent passageways extend through the wall from the interior surface to the exterior surface.

Embodiment 16 is the self-venting nozzle of any one of the preceding embodiments, further comprising a dynamic mixing assembly disposed upstream of the inlet end.

Embodiment 17 is the self-venting nozzle of any one of the preceding embodiments, wherein the nozzle comprises a first nozzle portion and a second nozzle portion and wherein the nozzle outlet end is located on the first nozzle portion and the nozzle inlet end is located on the second nozzle portion.

Embodiment 18 is the self-venting nozzle of embodiment 17, wherein the one or more vent passageways are located at an interface between the first nozzle portion and the second nozzle portion.

Embodiment 19 is the self-venting nozzle of any one of the preceding embodiments, wherein the one or more passageways are adapted to allow passage of fluid having a viscosity of no greater than 500,000 mPa·s.

Embodiment 20 is the self-venting nozzle of any one of the preceding embodiments, wherein the one or more vent passageways have an effective cross-sectional area of from $6.4\times10^{-5}$ $cm^2$ to 0.65 $cm^2$.

Embodiment 21 is the self-venting nozzle of any one of the preceding embodiments, wherein the one or more vent passageways have a gap distance of from 0.0254 mm to 2.54 mm.

Embodiment 22 is the self-venting nozzle of any one of the preceding embodiments, wherein the one or more vent passageways have a vent length of from 0.0254 mm to 25.4 cm.

Embodiment 23 is a nozzle system comprising the self-venting nozzle of any one of the preceding embodiments and a dispenser.

Embodiment 24 is the nozzle system of embodiment 23, wherein the dispenser comprises an outlet port adapted to connect to the mating portion of the self-venting nozzle.

Embodiment 25 is the nozzle system of anyone of embodiments 23-24, wherein the dispenser is arranged upstream of the self-venting nozzle.

Embodiment 26 is the nozzle system of anyone of embodiments 23-25, wherein the dispenser comprises a mixing tip.

Embodiment 27 is the nozzle system of embodiment 26, wherein the mixing tip is a dynamic mixing tip.

Embodiment 28 is the nozzle system of embodiment 26, wherein the mixing tip is a static mixing tip.

Embodiment 29 is a method of dispensing a fluid having a gas entrained therein, comprising:

providing a self-venting nozzle according to any one of embodiments 1-20; and dispensing the fluid through the self-venting nozzle;

wherein as fluid is dispensed through the self-venting nozzle, the entrained gas escapes to the atmosphere through vent passageways in the self-venting nozzle.

Embodiment 30 is the method of embodiment 29, wherein the fluid enters the vent passageways but does not escape to the atmosphere through the vent passageways.

Embodiment 31 is the method of embodiment 29, further comprising mixing two or more components upstream of the self-venting nozzle to form the fluid.

Embodiment 32 is the method of any one of embodiments 29 or 30, wherein the fluid viscosity is no greater than 500,000 mPa·s.

The complete disclosure of the patents, patent documents, and publications cited in the Background, the Detailed Description of Exemplary Embodiments, and elsewhere herein are incorporated by reference in their entirety as if each were individually incorporated Illustrative embodiments of the self-venting nozzles, nozzle systems, assemblies, and methods are discussed and reference has been made to some possible variations. These and other variations and modifications in the invention will be apparent to those skilled in the art without departing from the scope of the invention, and it should be understood that this invention is not limited to the illustrative embodiments set forth herein. Accordingly, the invention is to be limited only by the claims provided below and equivalents thereof.

Examples

Unless stated otherwise, the following components and materials, described according to their respective trade designations and part numbers, were obtained from 3M Company, St. Paul, Minn.

A two-part filler material, trade designation "CONTROLLED FLOW SEAM SEALER, PART No. 08329" was transferred into the 1:1 volumetric ratio cartridge of a model "DYNAMIC MIXING APPLICATOR, PART No. 05846". A "DYNAMIC MIXING NOZZLE, PART No. 55847", was attached to the cartridge and a 4 inch (10.16 cm) long polypropylene injection molded "DYNAMIC MIXING NOZZLE EXTENSION, PART No. 58207", was press fitted onto the mixing nozzle. The cartridge and nozzle assembly was then attached to the dynamic mixing applicator and the seam sealer extruded from the cartridge by means of the applicator. However, as the seam sealer was extruded, a large air bubble became trapped within the nozzle extension. Unable to vent through the extension outlet, the entrapped air was continuously expelled in a series of smaller bubbles embedded in the surface of the extruded seam sealer.

An exemplary self-venting nozzle extension was fabricated during the injection molding process, comprising of nine equally spaced grooves along the inner wall of the extension, parallel to the flow axis and adjacent to the inlet section, as shown in FIG. 1B. The dimensions of these grooves were approximately 0.30 inches long, by 0.030 inches wide and 0.015 inches deep (7.62 mm by 0.76 mm by 0.38 mm). The extension was press fitted onto the dynamic mixing nozzle of the cartridge and the seam sealer extruded. The large air bubble that formed in the nozzle extension traveled in the opposite direction to the extruded sealer and was ultimately expelled from the self-venting nozzle extension, between the extension inlet and the dynamic mixing nozzle, via the grooves. The extruded seam sealer remained free of air bubbles.

What is claimed is:

1. A self-venting nozzle adapted to vent a gas entrained in a fluid to an atmosphere, the nozzle comprising:

a nozzle inlet end;

a nozzle outlet end;

a nozzle wall extending between the nozzle inlet end and nozzle outlet end and having an interior surface defining a fluid channel surrounding a nozzle flow axis; and one or more vent passageways providing fluid communication between the fluid channel and the atmosphere, wherein the one or more vent passageways comprise grooves in the interior surface, and wherein the nozzle comprises a mating portion adapted to connect to a dispenser and wherein the one or more vent passageways extend along at least a portion of the mating portion.

2. The self-venting nozzle of claim 1, wherein the one or more vent passageways run in a direction substantially parallel to the flow axis.

3. The self-venting nozzle of claim 1, further comprising a second non-mating portion disposed between the mating portion and the inlet end.

4. The self-venting nozzle of claim 3, wherein the one or more vent passageways extend along at least a portion of the second non-mating portion.

5. The self-venting nozzle of claim 1, further comprising a dynamic mixing assembly disposed upstream of the inlet end.

6. The self-venting nozzle of claim 1, wherein the nozzle comprises a first nozzle portion and a second nozzle portion and wherein the nozzle outlet end is located on the first nozzle portion and the nozzle inlet end is located on the second nozzle portion.

7. The self-venting nozzle of claim 6, wherein the one or more vent passageways are located at an interface between the first nozzle portion and the second nozzle portion.

8. The self-venting nozzle of claim 1, wherein the one or more vent passageways have a cross-sectional area of from $6.4\times10^{-5}$ $cm^2$ to 0.65 $cm^2$.

9. A nozzle system comprising the self-venting nozzle of claim 1 and a dispenser.

10. The nozzle system of claim 9, wherein the dispenser comprises a mixing tip.

11. The nozzle system of claim 10, wherein the mixing tip is a dynamic mixing tip.

12. A method of dispensing a fluid having a gas entrained therein, comprising:

providing a self-venting nozzle according to claim 1; and dispensing the fluid through the self-venting nozzle;

wherein as fluid is dispensed through the self-venting nozzle, the entrained gas escapes to the atmosphere through vent passageways in the self-venting nozzle.

13. The method of claim 12, wherein the fluid enters the vent passageways but does not escape to the atmosphere through the vent passageways.

14. The method of claim 12, further comprising mixing two or more components upstream of the self-venting nozzle to form the fluid.

15. The method of claim 12, wherein the fluid viscosity is no greater than 500,000 mPa·s.

16. A self-venting nozzle adapted to vent a gas entrained in a fluid to an atmosphere, the nozzle comprising:

a nozzle inlet end;

a nozzle outlet end;

a nozzle wall extending between the nozzle inlet end and nozzle outlet end and having an interior surface defining a fluid channel surrounding a nozzle flow axis and an exterior surface; and one or more vent passageways providing fluid communication between the fluid channel and the atmosphere, wherein the one or more vent passageways extend through the wall from the interior surface to the exterior surface.

17. A self-venting nozzle adapted to vent a gas entrained in a fluid to an atmosphere, the nozzle comprising:

a nozzle inlet end;

a nozzle outlet end;

a nozzle wall extending between the nozzle inlet end and nozzle outlet end and having an interior surface defining a fluid channel surrounding a nozzle flow axis;

one or more vent passageways providing fluid communication between the fluid channel and the atmosphere, an exterior surface; and a mating portion, wherein the one or more vent passageways comprise grooves in the exterior surface.

18. The self-venting nozzle of claim 17, wherein the one or more vent passageways extend along the exterior surface.

19. The self-venting nozzle of claim 17, wherein the one or more vent passageways extend along at least a portion of the mating portion.

20. The self-venting nozzle of claim 17, wherein the one or more vent passageways run in a direction substantially parallel to the flow axis.

21. The self-venting nozzle of claim 17, wherein the nozzle further comprises a second non-mating portion disposed between the mating portion and the inlet end.

22. The self-venting nozzle of claim 21, wherein the one or more vent passageways extend along at least a portion of the second non-mating portion.

23. The self-venting nozzle of claim 17, further comprising a dynamic mixing assembly disposed upstream of the inlet end.

24. The self-venting nozzle of claim 17, wherein the nozzle comprises a first nozzle portion and a second nozzle portion and wherein the nozzle outlet end is located on the first nozzle portion and the nozzle inlet end is located on the second nozzle portion.

25. The self-venting nozzle of claim 24, wherein the one or more vent passageways are located at an interface between the first nozzle portion and the second nozzle portion.

26. The self-venting nozzle of claim 17, wherein the one or more vent passageways have a cross-sectional area of from $6.4\times10^{-5}$ $cm^2$ to 0.65 $cm^2$.

27. A nozzle system comprising the self-venting nozzle of claim 17 and a dispenser.

28. The nozzle system of claim 27, wherein the dispenser comprises a mixing tip.

29. The nozzle system of claim 28, wherein the mixing tip is a dynamic mixing tip.

* * * * *